United States Patent [19]

Kraft

[11] 4,289,007

[45] Sep. 15, 1981

[54] APPARATUS FOR HYDRAULICALLY FORMING SHEET METAL PULLEYS

[75] Inventor: Derald H. Kraft, Canton, Ohio

[73] Assignee: Dyneer Corporation, Canton, Ohio

[21] Appl. No.: 100,649

[22] Filed: Dec. 5, 1979

[51] Int. Cl.[3] ..... B21D 26/04

[52] U.S. Cl. ..... 72/58; 72/59; 72/62; 29/159 R

[58] Field of Search ..... 72/58–62; 29/159 R, 421 R

[56] References Cited

U.S. PATENT DOCUMENTS

| | | | |
|---|---|---|---|
| 349,718 | 9/1886 | Hollerith | 72/59 |
| 701,549 | 6/1902 | Deering | 72/62 |
| 3,675,453 | 7/1972 | Marsch | 72/58 |
| 3,820,369 | 6/1974 | Tominega | 72/55 |
| 3,837,200 | 9/1974 | Wolbert | 72/57 |
| 4,134,285 | 1/1979 | Iaconetti et al. | 29/159 R |
| 4,173,136 | 11/1979 | Schroth | 29/159 R |

FOREIGN PATENT DOCUMENTS

| | | |
|---|---|---|
| 1498303 | 9/1967 | France . |
| 1508273 | 11/1967 | France . |

*Primary Examiner*—Leon Gilden
*Attorney, Agent, or Firm*—Frease & Bishop

[57] ABSTRACT

Apparatus for forming a sheet metal pulley from a cup-shaped blank in a single hydraulic forming operation. A pair of die holding members supports a plurality of groove-forming inner dies and is movably mounted on a base for horizontal reciprocal movement between open and closed die positions for capturing a pulley-forming blank therebetween. Tapered pins extend vertically through aligned openings formed in overlapping shelf members of the die holding members to wedgingly clamp the dies toward each other and to lock them in a horizontally closed position. A ram plate is mounted on a plurality of vertical posts for reciprocal vertical movement with respect to the captured blank. The ram plate has a top die which exerts axial pressure on the hub portion of the blank during the hydraulic bulging of the blank side wall by a confined fluid within the blank in cooperation with the groove-forming inner dies. A plurality of pistons mounted on the vertical ram plate cammingly engage mating surfaces provided on the posts and adjacent cam shafts to mechanically lock the ram plate die in a vertically closed position. A burst of high pressure is applied to the trapped, partially formed pulley to final form the pulley by setting the metal of the pulley against the inner dies by exceeding the elastic limit of the metal, eliminating springback after the pulley is removed from the dies. Certain of the groove-forming inner dies are movable vertically independently of the top ram plate and hub die by hydraulic pistons to permit variation in the groove-forming sequence during the pulley forming procedure.

17 Claims, 27 Drawing Figures

FIG.12
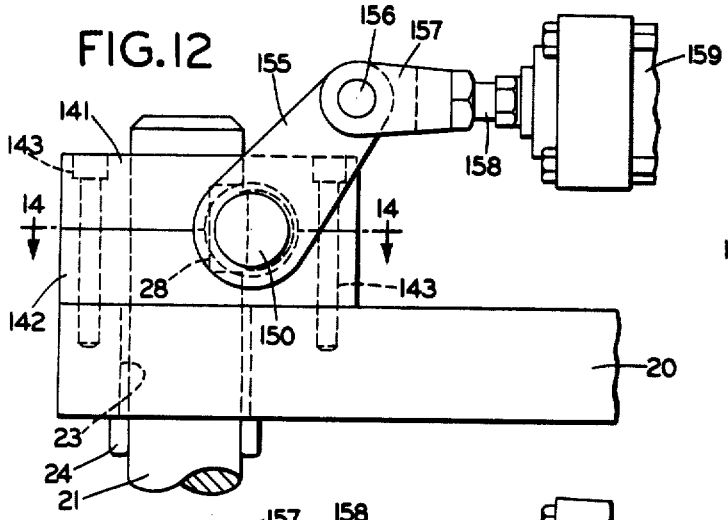
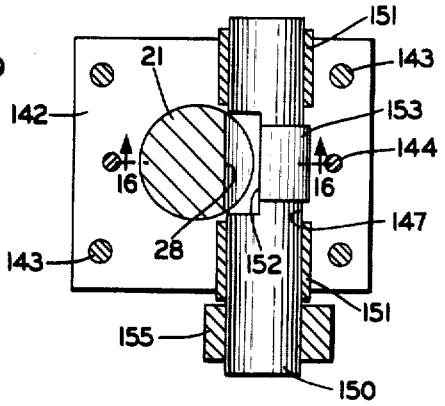
FIG.14
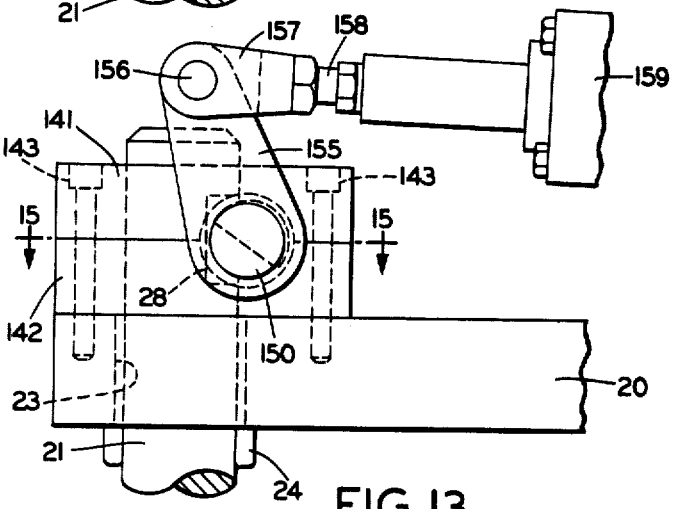
FIG.13
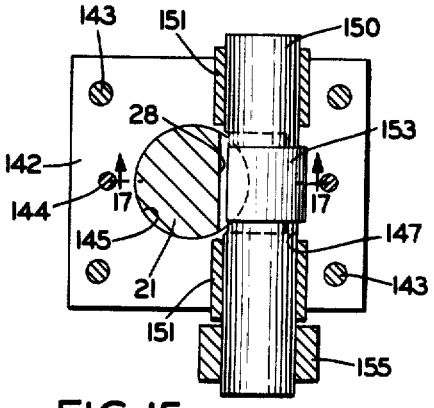
FIG.15
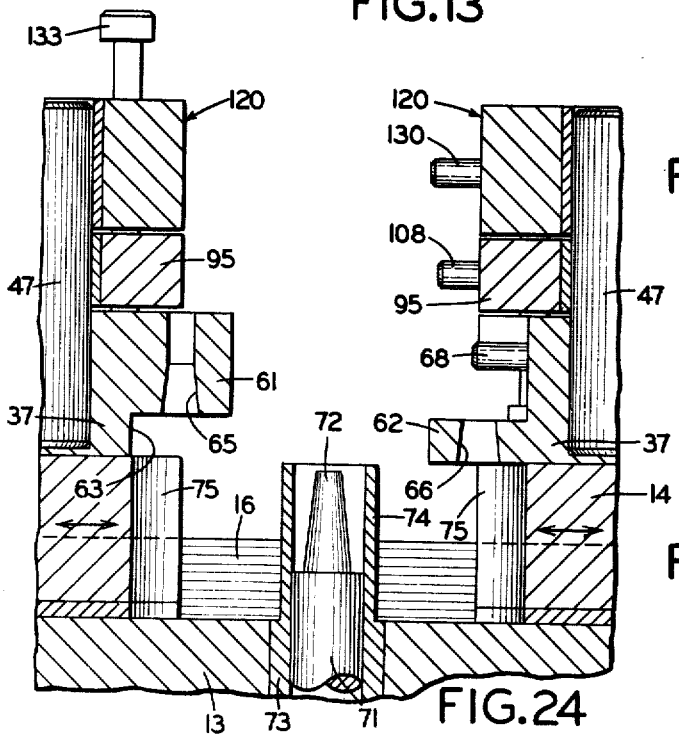
FIG.24
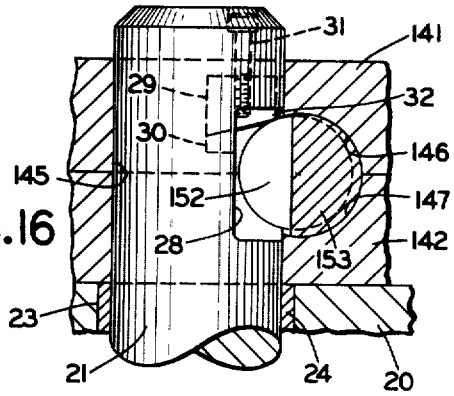
FIG.16
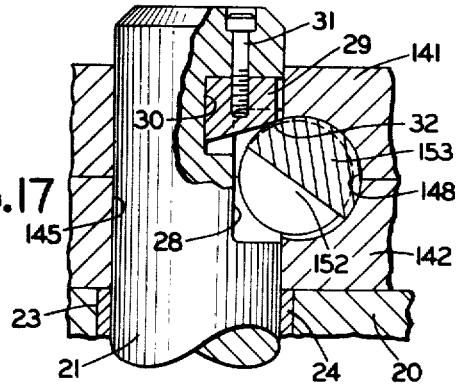
FIG.17

APPARATUS FOR HYDRAULICALLY FORMING SHEET METAL PULLEYS

BACKGROUND OF THE INVENTION

1. Field of the Invention

The invention relates to an improved apparatus for hydraulically forming pulleys from cup-shaped sheet metal blanks in a continuous forming operation. More particularly, the invention relates to an apparatus having mechanically locking means for locking a pair of half-die holding members and groove-forming dies in both the horizontal and vertical directions in a closed position about a cup blank and formed pulley, preventing the formation of die marks on the hydraulically formed pulley product.

2. Description of the Prior Art

Numerous apparatus and procedures have been proposed for forming sheet metal pulleys from a cup-shaped blank by hydraulically bulging the cup walls during the axial compression of the cup-shaped blank to force the metal of the cup wall outwardly into forming grooves of the surrounding dies. Some examples of such apparatus and methods which have been proposed and used are shown in U.S. Pat. Nos. 2,493,053, 2,743,691, 2,929,345, 3,124,090, 3,335,590, 3,630,056, and 3,820,369. The present invention is a particular improvement on the apparatus shown in U.S. Pat. Nos. 3,837,200 and 3,935,627.

Known apparatus such as disclosed in these patents have proven somewhat satisfactory in forming the final pulley product. However, a particular problem which has developed during the hydraulic bulge forming of a pulley with known equipment is the creation of die junction marks on the formed pulley. These die marks require an additional machining or metal spinning procedure to remove the marks. Considerable hydraulic pressure is exerted outwardly against the metal of the cup wall in order to force the metal into the die forming grooves. Consequently, this metal is forced outwardly into the junction areas of the mated die sections. Even though these joints are relatively small and only a small amount of metal is forced therein, it results in an imperfection or ridge on the produced pulley, which must be removed by an additional manufacturing operation. Even though the dies are clamped in a closed position in most prior apparatus, the exerted hydraulic pressure still forces the dies apart a sufficient distance to create die marks on the formed pulley.

This problem becomes increasingly acute when a burst of an extremely high pressure is exerted in the hydraulic bulging fluid to impart a final set to the metal, such as generated by an electrical discharge, as shown in U.S. Pat. No. 3,394,569 or when a hydraulic intensifier is used.

Thus, the need has existed for an apparatus for use in hydraulically bulge forming metal pulleys which mechanically locks the pulley forming dies in both the horizontal and vertical closed directions to prevent the formation of die junction marks on the formed pulley product.

SUMMARY OF THE INVENTION

Objectives of the invention include providing an improved apparatus for hydraulically forming a grooved pulley from a sheet metal blank in a continuous operation, eliminating additional handling and work-performing steps being performed on the pulley cup; providing such an improved apparatus which uses a pair of die holding members on which are mounted groove-forming dies for trapping the pulley cup blank and for forming the pulley grooves, and in which tapered locking pins clamp the die holding members and dies in a horizontally closed position prior to the start of the hydraulic bulging operation to prevent the formation of die marks on the formed pulley; providing such an improved apparatus in which a vertically reciprocal ram having a hub-forming die mounted thereon axially compresses the cup during the hydraulic bulging operation in partially forming the pulley grooves, and in which the ram and top die are mechanically locked at the bottom of their compression stroke prior to the injection of a burst of high pressure-forming fluid which imparts a final set to the metal of the formed pulley; providing such an improved apparatus in which either single or multi-groove sheet metal pulleys may be formed in the single step operation; providing such an improved apparatus in which the groove-forming dies include a top, intermediate and bottom die, with piston means being engaged with the top and intermediate does enabling the vertical movement of these dies to be controlled independently of each other and of the vertical ram to provide for variations and adjustments in the groove-forming procedure; and providing such an improved apparatus which eliminates difficulties heretofore encountered, achieves the stated objectives simply, inexpensively and efficiently, and solves problems and satisfies needs existing in the art These objectives and advantages are obtained by the improved apparatus for hydraulically forming sheet metal pulleys, the general nature of which may be stated as including base means; a pair of die holding members mounted on the base means for reciprocal movement toward and away from each other on the base means; internal die means adapted to support a sheet metal blank between the die holding members; groove-forming die means mounted on each of the die holding members for capturing a blank supported by the internal die means and for forming at least a single groove in the side wall of the blank; pin means operatively engageable with the die holding members for clamping the die holding members and groove-forming die means in a closed position in the horizontal direction; a plurality of post means mounted on the base means and extending vertically upwardly therefrom; means for supplying fluid to the interior of a captured blank when the die holding members and die means are in closed position; ram means mounted on the post means for reciprocal vertical axial movement therealong; hub wallengaging die means mounted on the ram means and engageable with the bottom hub wall of a blank for axially compressing a captured blank in cooperation with hydraulic bulging of the side wall outwardly toward the groove-forming die means when the ram means moves downwardly toward a die vertical closed position; locking means operatively engageable with the post means and ram means for locking the hub wall-engaging die means in a vertically closed die position when the ram means is at the end of its axial compression stroke; and means for injecting a momentary burst of high pressure in the trapped hydraulic fluid sufficient to final form the pulley groove and to set the metal by exceeding the elastic limit thereof.

BRIEF DESCRIPTION OF THE DRAWINGS

A preferred embodiment of the invention—illustrative of the best mode in which applicants have contemplated applying the principle—is set forth in the following description and shown in the accompanying drawings, and is particularly and distinctly pointed out and set forth in the appended claims.

FIG. 12 is an enlarged fragmentary elevational view showing one of the vertical locking assemblies in unlocked position;

FIG. 13 is a view similar to FIG. 12 showing the locking assembly in locked position;

FIG. 14 is a sectional view taken on line 14—14, FIG. 12;

FIG. 15 is a sectional view taken on line 15—15, FIG. 13;

FIG. 16 is an enlarged fragmentary sectional view taken on line 16—16, FIG. 14;

FIG. 17 is an enlarged fragmentary sectional view taken on line 17—17, FIG. 15;

FIG. 24 is a fragmentary sectional view similar to FIG. 9 with the die holding members shown in lowered position;

Similar numerals refer to similar parts throughout the drawings.

DESCRIPTION OF THE PREFERRED EMBODIMENT

Figure 2:
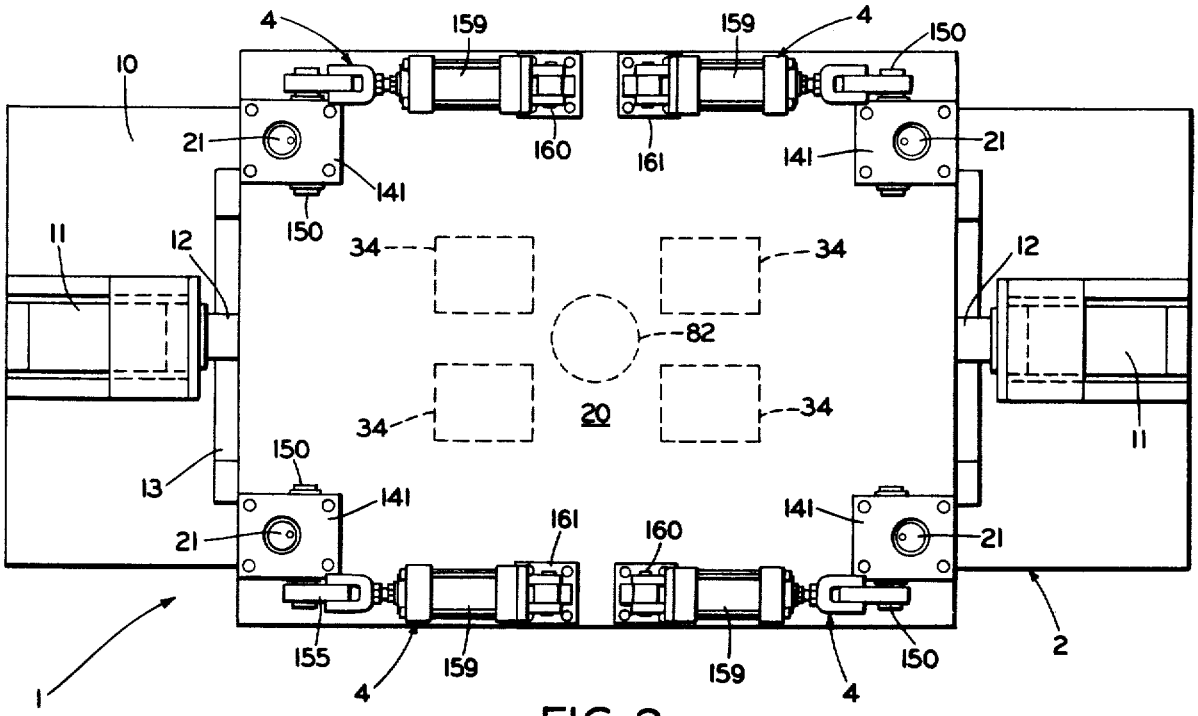
FIG. 2 is a top plan view of the improved pulley-forming apparatus shown in FIG. 1.
Figure 1:
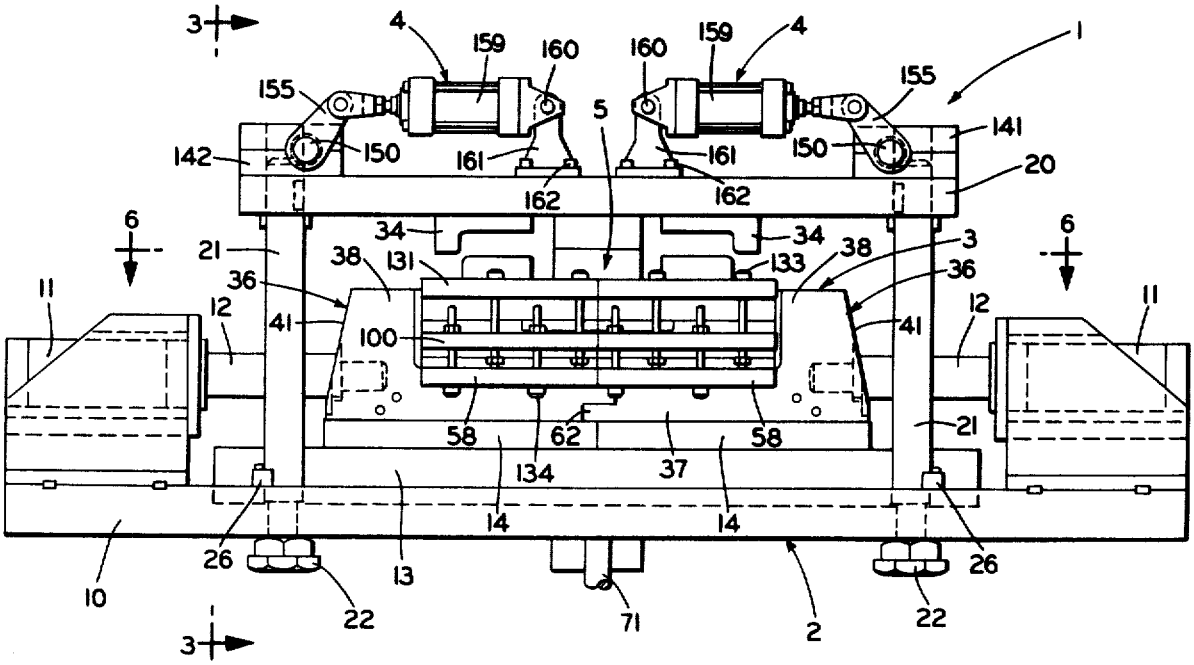
FIG. 1 is an elevational view of the improved hydraulic pulley-forming apparatus with the top ram plate being shown in raised position.
Figure 3:
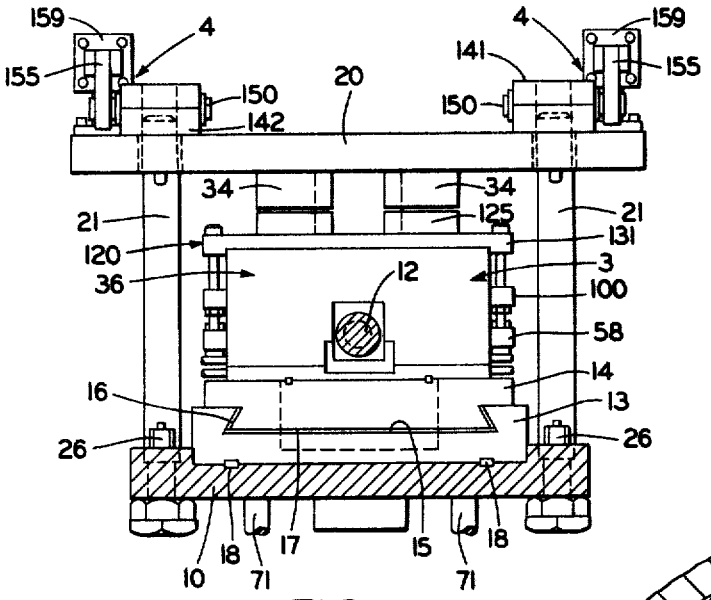
FIG. 3 is a sectional view taken on line 3—3, FIG. 1.

The improved hydraulic pulley-forming apparatus is indicated generally at 1, and is shown particularly in fully assembled position in FIGS. 1, 2 and 3. Apparatus 1 includes a plurality of various combinations of components which are referred to as subassemblies and are described individually below for clarity. These various subassemblies include a horizontal and vertical slide subassembly 2, a die holder and horizontal locking subassembly 3, a vertical locking subassembly 4, a pulley groove-forming inner die subassembly 5, and an interior die subassembly 6.

Horizontal and Vertical Slide Subassembly 2

Subassembly 2 includes a fixed horizontal base 10 with a pair of longitudinally spaced hydraulic cylinders 11 mounted in a fixed position at opposite ends of base 10. Piston rods 12 of cylinders 11 are connected to a horizontally slidable portion of die holder and horizontal locking subassembly 3 described in greater detail below. These slidable portions of subassembly 3 are mounted on a fixed horizontal bottom slide 13 by a pair of top movable slides 14 (FIG. 3), which are slidably mounted in a longitudinally extending groove 15 formed in bottom slide 13. Side and bottom wear plates 16 and 17 are attached to movable slides 14 to provide bearing surfaces for the sliding contact between top slides 14 and fixed bottom slide 13. Bottom slide 13 is mounted on base 10 by a pair of longitudinally extending keys 18 or other attachment means. Accordingly, the horizontally slidable portions of die holder and horizontal locking subassembly 3 are horizontally reciprocally movable in groove 15 of fixed bottom slide 13 upon actuation of hydraulic cylinders 11.

Figure 6:
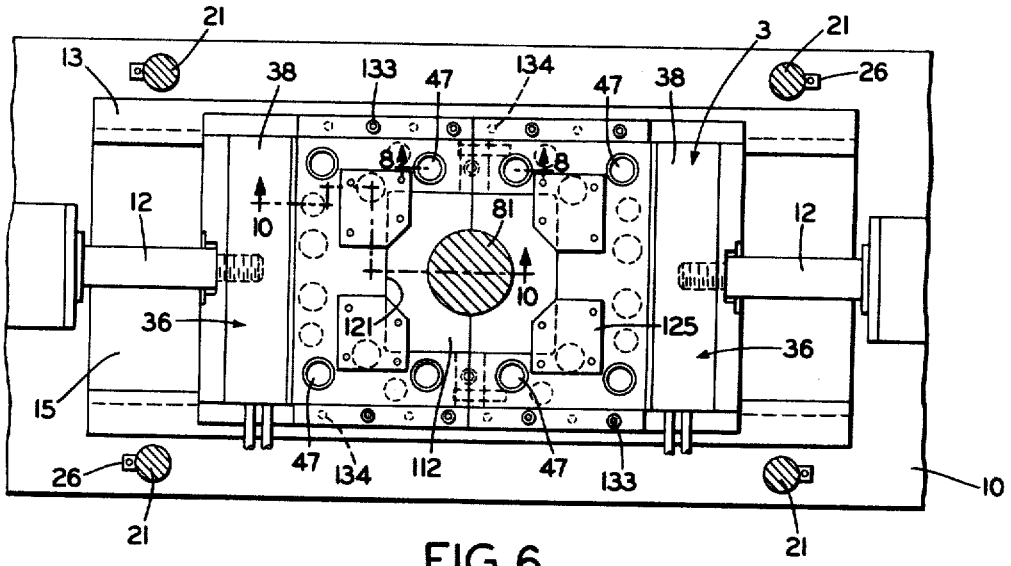
FIG. 6 is a fragmentary sectional view taken on line 6—6, FIG. 1, with the die holding members and groove-forming dies being shown in closed, locked position.
Figure 7:
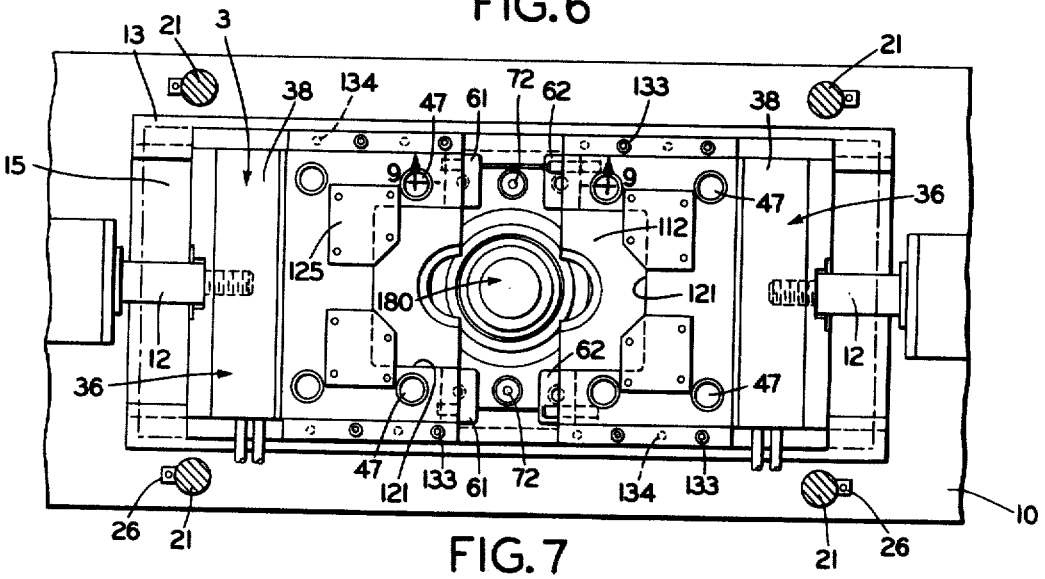
FIG. 7 is a fragmentary sectional view similar to FIG. 6 with the die holding members and groove-forming dies being shown in partially open position.

A vertically movable top ram plate 20 is supported by four rectangularly spaced, vertically extending guide posts 21. Posts 21 are fixed to base 10 by locking nuts 22. The upper ends of posts 21 extend through complementary-shaped holes 23 formed adjacent the corners of ram plate 20 (FIGS. 1, 3 and 12) into which bearing sleeves 24 are telescopically mounted to provide a bearing surface between plate 20 and posts 21 for the reciprocal vertical movement of plate 20. A plurality of alignment blocks 26 are mounted on base 10 and engage the lower ends of posts 21 (FIGS. 1, 6 and 7).

Referring particularly to FIGS. 12 through 17, a cutout portion 28 is formed adjacent the top of each guide post 21. Cutout portion 28 forms a segment of a circle when viewed in horizontal cross section (FIGS. 14 and 15). A bearing plate 29 is mounted within a slot 30 which is formed in each post 21 by a mounting screw 31 (FIGS. 16 and 17). Each bearing plate 29 is provided with a curved camming surface or corner 32 which projects into cutout portion 28.

Four top locking plates 34 are mounted on the bottom surface of ram plate 20 by bolts 35 (FIGS. 2 and 10) and project downwardly therefrom and are arranged in a rectangular relationship, as shown by dotted lines in FIG. 2.

Figure 25:
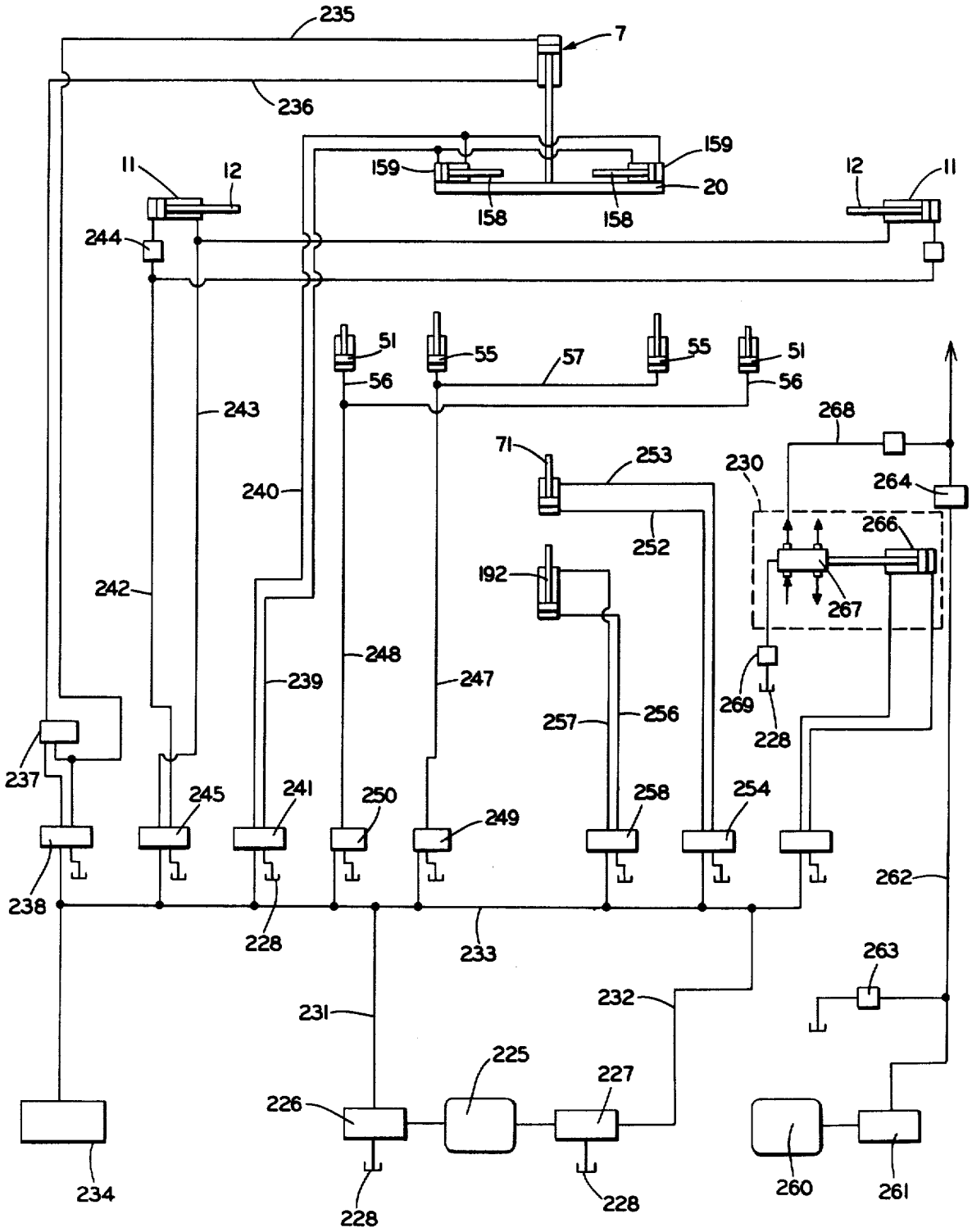
FIG. 25 is a diagrammatic schematic view illustrating portions of the hydraulic system of the improved apparatus.

Apparatus 1 is intended to be mounted on the base of a usual hydraulic press (not shown) with the ram of the hydraulic press indicated generally at 7 and shown diagrammatically in FIG. 25 being connected to top ram plate 20 of the subassembly 2 to impart vertical reciprocal movement to ram plate 20.

An annular-shaped hub-forming die 80 (FIG. 10) is mounted in a spaced relationship from the bottom of ram plate 20 by a pair of disc-shaped spacers 81 and 82. Spacers 81 and 82 are fixedly mounted on plate 20 and die 80 for vertical reciprocating movement with plate 20 and die 80.

Die Holder and Horizontal Locking Subassembly 3

Figure 10:
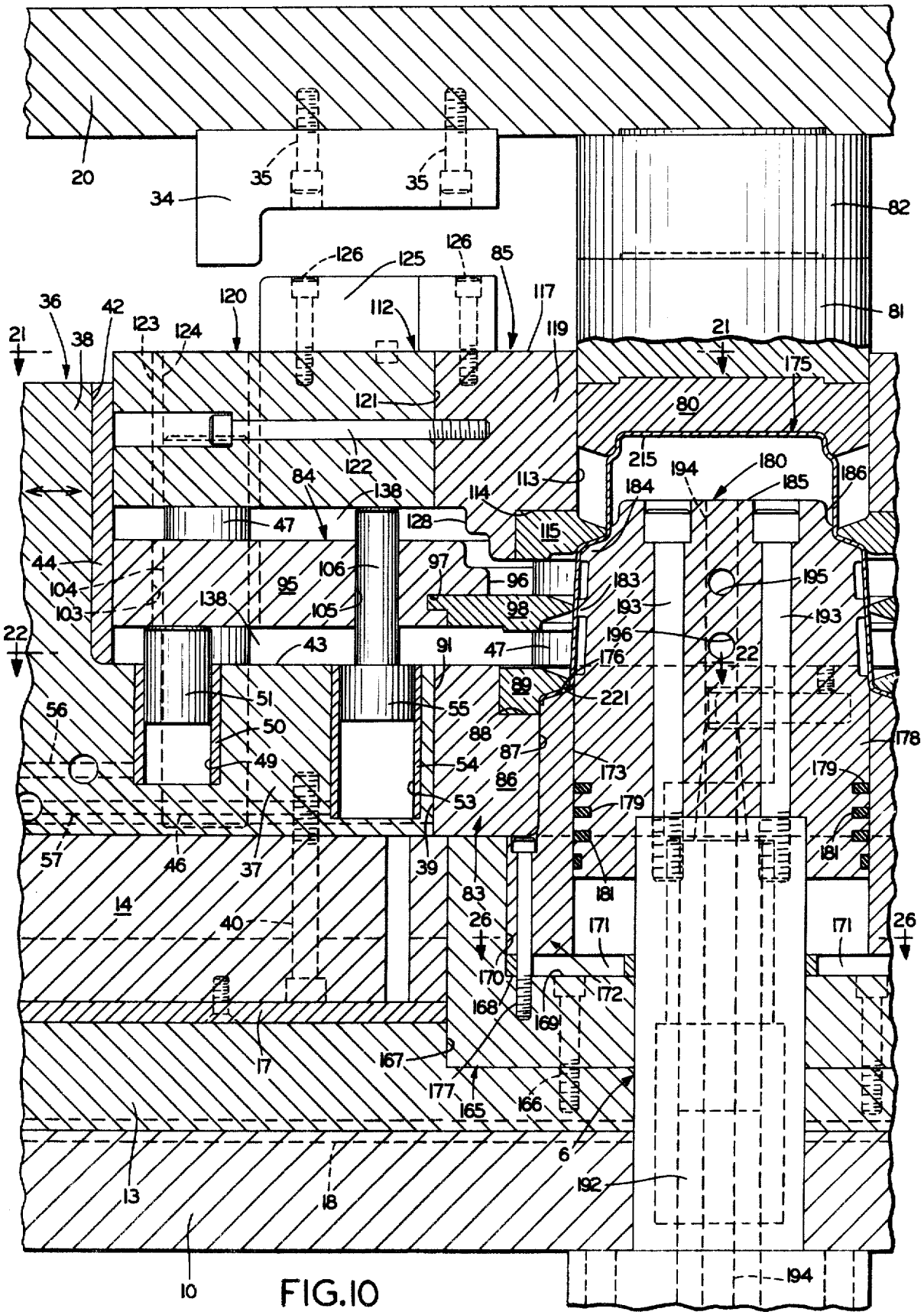
FIG. 10 is an enlarged fragmentary sectional view showing the groove-forming dies in closed position about a pulley cup at the start of a pulley-forming operation with the ram plate and top die in partially closed position.

Subassembly 3 includes a pair of die holding members indicated generally at 36, and shown particularly in FIGS. 1, 6, 7, 21 and 22, and partially in FIG. 10. Die holding members 36 are similar to each other. Thus, only one holding member 36 is described and shown in the drawings in detail.

Each die holding member 36 has a generally L-shaped configuration with a horizontal base portion 37 and a vertically extending end portion 38 to which piston rod 12 is connected for imparting reciprocal movement to member 36. Base portion 37 is formed with a rectangular cutout portion 39 (FIG. 22) in which the pulley groove-forming inner die subassembly 5 is mounted. Each die holding member 36 is attached by a plurality of bolts 40 (FIG. 10) to top movable slide 14 for horizontal reciprocal movement therewith. Vertical end portion 38 has a vertically extending inner surface 42 which forms a generally right angle with the top surface 43 of horizontal base 37. A wear plate 44 is mounted on vertical inner surface 42 for sliding engagement with various components of inner die subassembly 5.

Figure 8:
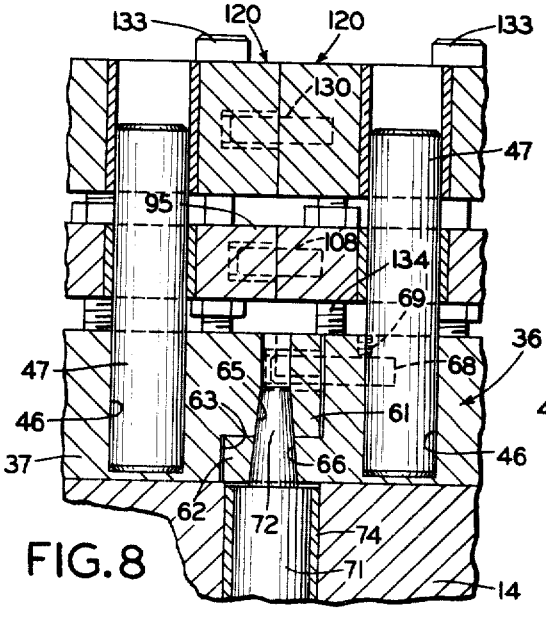
FIG. 8 is an enlarged fragmentary sectional view taken on line 8—8, FIG. 6, showing the die holding members and dies being locked in horizontally closed position by one of the tapered locking pins.
Figure 21:
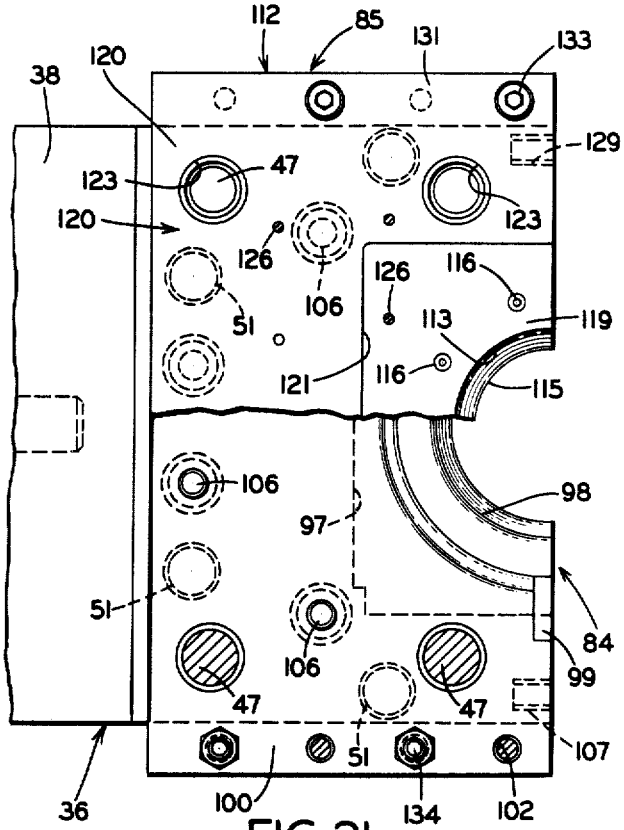
FIG. 21 is a reduced fragmentary sectional view with portions broken away taken on line 21—21, FIG. 10.
Figure 20:
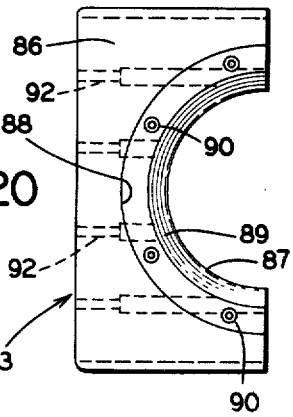
FIG. 20 is a top plan view of the bottom groove-forming die and holder therefor.
Figure 22:
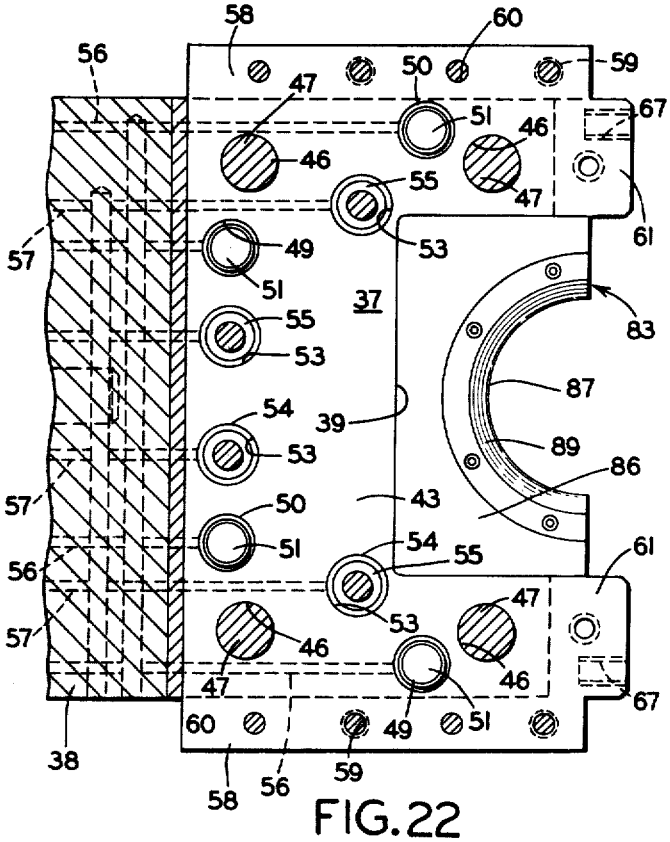
FIG. 22 is a reduced fragmentary sectional view with portions broken away taken on line 22—22, FIG. 10.

Referring to FIGS. 21 and 22, a plurality of vertically extending holes are formed in horizontal base portion 37 of each member 36 and extend downwardly from top surface 43. These various holes include four guide pin holes 46 in which guide pins 47 are telescopically mounted (FIG. 8). There are four intermediate die holder piston bores 49 having sleeves 50 mounted therein and containing hydraulically actuated pistons 51 (FIG. 10). Also, there are four top die holder piston bores 53 formed in base portion 37 having sleeves 54 in which pistons 55 are slidably mounted (FIG. 10).

Hydraulic supply lines 56 and 57 are formed in and extend horizontally through base portion 37 of members 36 and communicate with piston bores 49 and 53, respectively (FIGS. 10 and 22).

Figure 23:
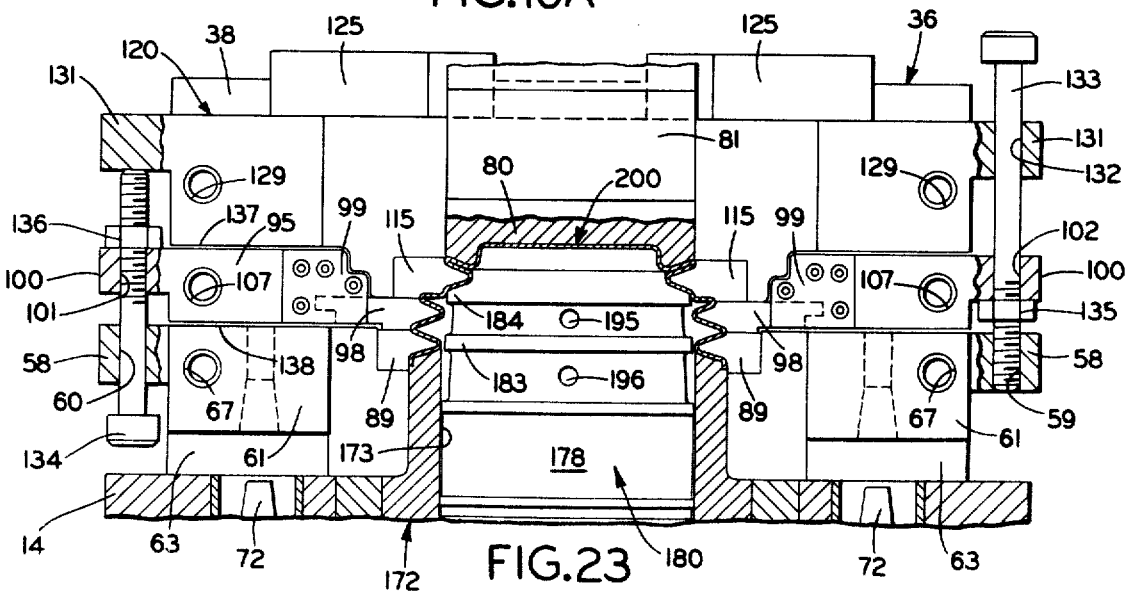
FIG. 23 is a reduced fragmentary sectional view taken on line 23—23, FIG. 11, showing particularly the adjusting bolts for the top and intermediate dies.

A pair of flanges 58 are formed integrally with and extend horizontally transversely outwardly from top surface 43 on both sides of horizontal base portion 37 and extend longitudinally therealong (FIGS. 1, 22 and 23). Flanges 58 are formed with a series of alternating spaced threaded holes 59 and smooth bore unthreaded holes 60 (FIGS. 22 and 23) for adjusting the vertical spacing between the individual die holders of die subassembly 5, as discussed in greater detail below.

Figure 9:
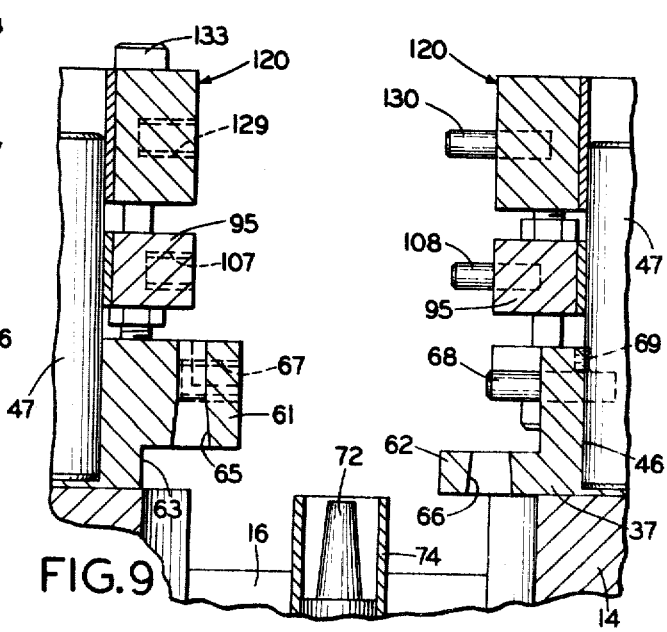
FIG. 9 is an enlarged fragmentary sectional view taken on line 9—9, FIG. 7, showing the die holding members and groove-forming dies in partially open position and with one of the tapered locking pins in retracted position.

In accordance with one of the features of the invention, the ends of horizontal base portions 37, which are located opposite of vertical end portions 38, are each formed with a pair of laterally spaced projecting shelves, indicated at 61 and 62, for the left-and right-hand die holding members 36, respectively, with respect to FIGS. 8, 9 and 22.

The left-hand pair of shelves 61 extend outwardly from adjacent the top of base portion 37 and are spaced above and from gaps 63 with respect to the top surface of top movable slide 14 (FIGS. 8 and 9). The right-hand end pair of shelves 62 are formed adjacent the bottom of horizontal base portion 37 and have a vertical thickness generally equal to the spacing of gap 63. Shelves 61 and 62 are formed with tapered, vertically extending holes 65 and 66, respectively, which are vertically aligned with each other when die holding members 36 are in closed position, shown particularly in FIGS. 6 and 8. Horizontally extending alignment holes 67 are formed in shelves 61 for receiving alignment pins 68 when die holder members 36 are in closed position. Pins 68 are mounted in the ends of base portion 37 by set screws 69 and are spaced above shelves 62.

A pair of hydraulically actuated pistons 71 (FIG. 24) are slidably mounted in bottom slide 13 for vertical movement within guide sleeves 73. Sleeves 73 have reduced top portions 74 which extend above slide 13 and are captured within pairs of mating semicircular recesses 75 formed in the inner ends of movable slides 14 when members 36 are in a closed position. Pistons 71 each have a tapered top end 72 which provides the horizontal locking means for inner die subassembly 5, as described in greater detail below.

Inner Die Subassembly 5

Subassembly 5 includes pairs of bottom, intermediate and top die means for forming the pulley grooves in the hydraulically formed cup-shaped pulley. These bottom, intermediate and top die means (FIGS. 10, 18, 19 and 20) are indicated generally at 83, 84 and 85, respectively, with each die means of the pair being similar to the other die means of the pair. Therefore, only one die means of each pair is described and shown in the drawings. Each die means includes a die holder and a semicircular groove-forming die.

Bottom die means 83 (FIGS. 10 and 20) includes a die holder 86 which has a generally rectangular configuration complementary to cutout 39 of die holding member base 37 and is formed with an inner semicylindrical recess 87. A semicircular groove 88 having a right angle cross-sectional configuration is formed in the upper inner edge of die holder 86 adjacent recess 87 for receiving a forming die 89 therein. Die 89 has a semicircular configuration complementary to recess 87 and groove 88 and is mounted on die holder 86 by a plurality of vertically extending bolts 90. Die holder 86 in turn is mounted on the inner face 91 of horizontal base cutout portion 39 of die holder member 36 by a plurality of horizontally extending bolts (not shown) which extend through holes 92 formed in die holder 86.

Each intermediate die means 84 (FIGS. 10 and 19) includes a die holder 95 and a groove forming die 98. Holder 95 has a generally rectangular configuration, and is formed with an inner semicircular recess 96. A generally rectangular-shaped undercut 97 is formed inwardly from recess 96 for receiving die 98. Die 98 is mounted in undercut 97 by a pair of bolted end plates 99.

Die holder 95 is formed with a pair of laterally spaced longitudinally extending flanges 100 (FIGS. 19 and 23) formed with a plurality of alternating threaded and unthreaded holes 101 and 102, respectively. Four guide pin holes 103 are formed vertically through die holder 95 and align with guide pin holes 46 formed in horizontal base portion 37 of member 36. A bearing sleeve 104 is telescopically mounted in each guide pin hole 103. Four holes 105 also are formed vertically through die holder 95, through which reduced diameter ends 106 of pistons 55 extend for operatively engaging top die means 85 (FIG. 10). A pair of alignment holes 107 (FIG. 19) are formed in the inner end face of the left-hand intermediate die holder 95 for receiving alignment pins 108 (FIGS. 8 and 9) which extend horizontally outwardly from the opposite end face of the other intermediate die holder 95.

Intermediate die means 84 are mounted on die holding members 36 by guide pins 47 (FIG. 10) which permit vertical movement only of die holders 95 and dies 98 with respect to holder members 36 whereby die means 84 will move in horizontal reciprocal movement with die holding members 36.

Each top die means 85 (FIGS. 10, 18 and 21) includes a die holder 112 which consists of a slide block 120 and a die holding block 119. Block 119 has a generally rectangular configuration and is formed with an inner semicircular recess 113. A generally rectangular-shaped undercut 114 is formed inwardly from recess 113 for receivably mounting a pulley groove forming die 115. Die 115 is mounted in undercut 114 by a plurality of bolts 116 which extend downwardly from top surface 117 of holder 112. Each forming die 115 has a semicircular configuration as do dies 89 and 98 so that they form an annular or circular configuration when in a horizontally closed position. Slide block 120 has a rectangular configuration and is formed with a rectangular-shaped inner cutout 121 for receivably mounting die holding block 119 by means of a plurality of horizontally extending bolts 122 (FIG. 10).

Four guide pin holes 123 extend vertically through slide block 120 for receiving guide pins 47 therein to slidably mount die holder 112 and top die 115 thereon. A sleeve 124 is mounted in each guide pin hole 123 to provide a bearing surface. Die block 119 is further secured to slide block 120 by a plurality of locking plates 125 which are mounted thereon by bolts 126 (FIG. 10). Locking plates 125 cooperatively engage with vertically aligned top locking plates 34 which are mounted on the bottom surface of ram plate 20, when ram plate 20 is in its bottom position (FIG. 11).

Figure 10A:
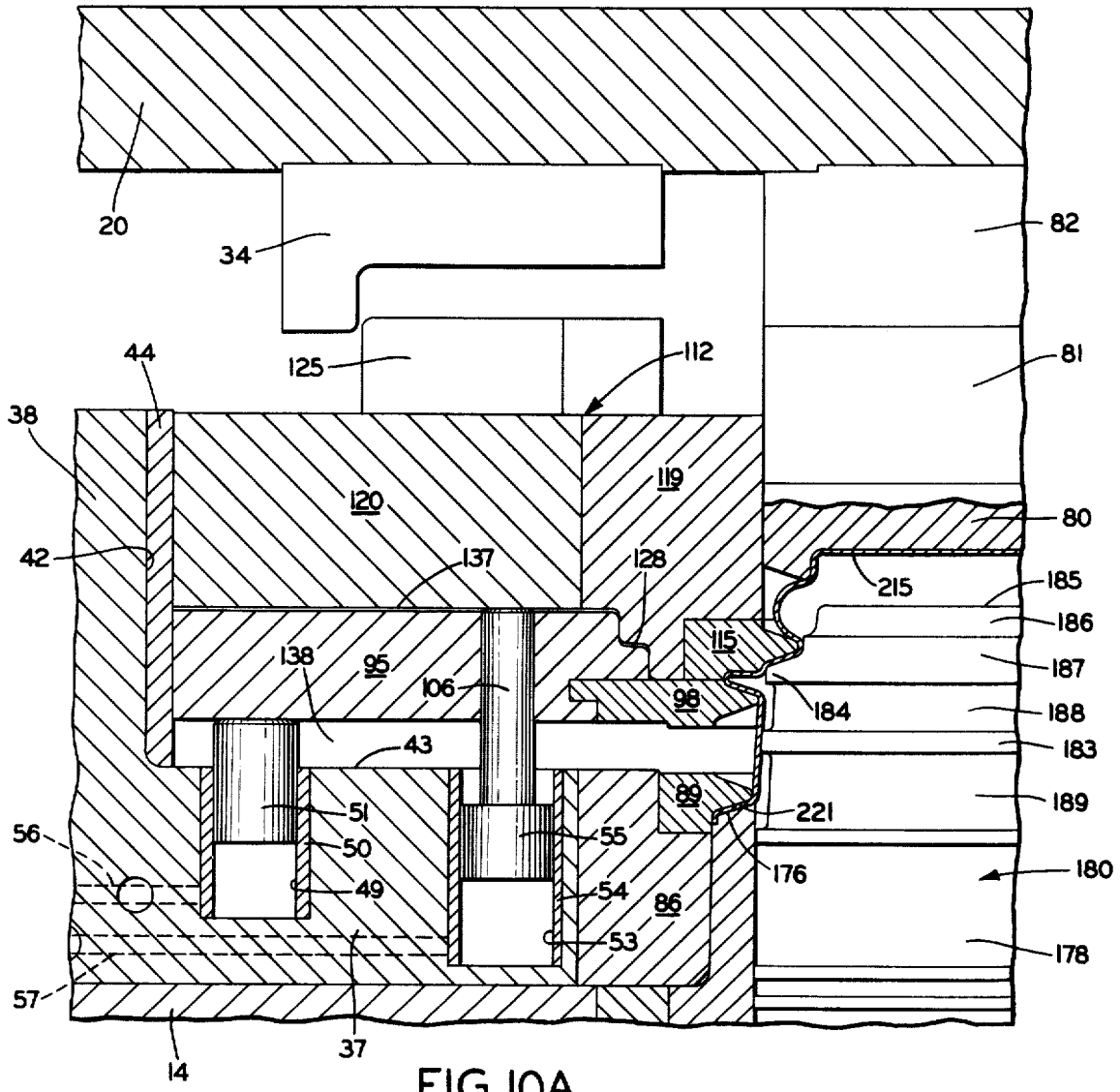
FIG. 10A is a sectional view similar to FIG. 10 showing the pulley-forming dies and associated components in an intermediate stage of the cup forming procedure.
Figure 11:
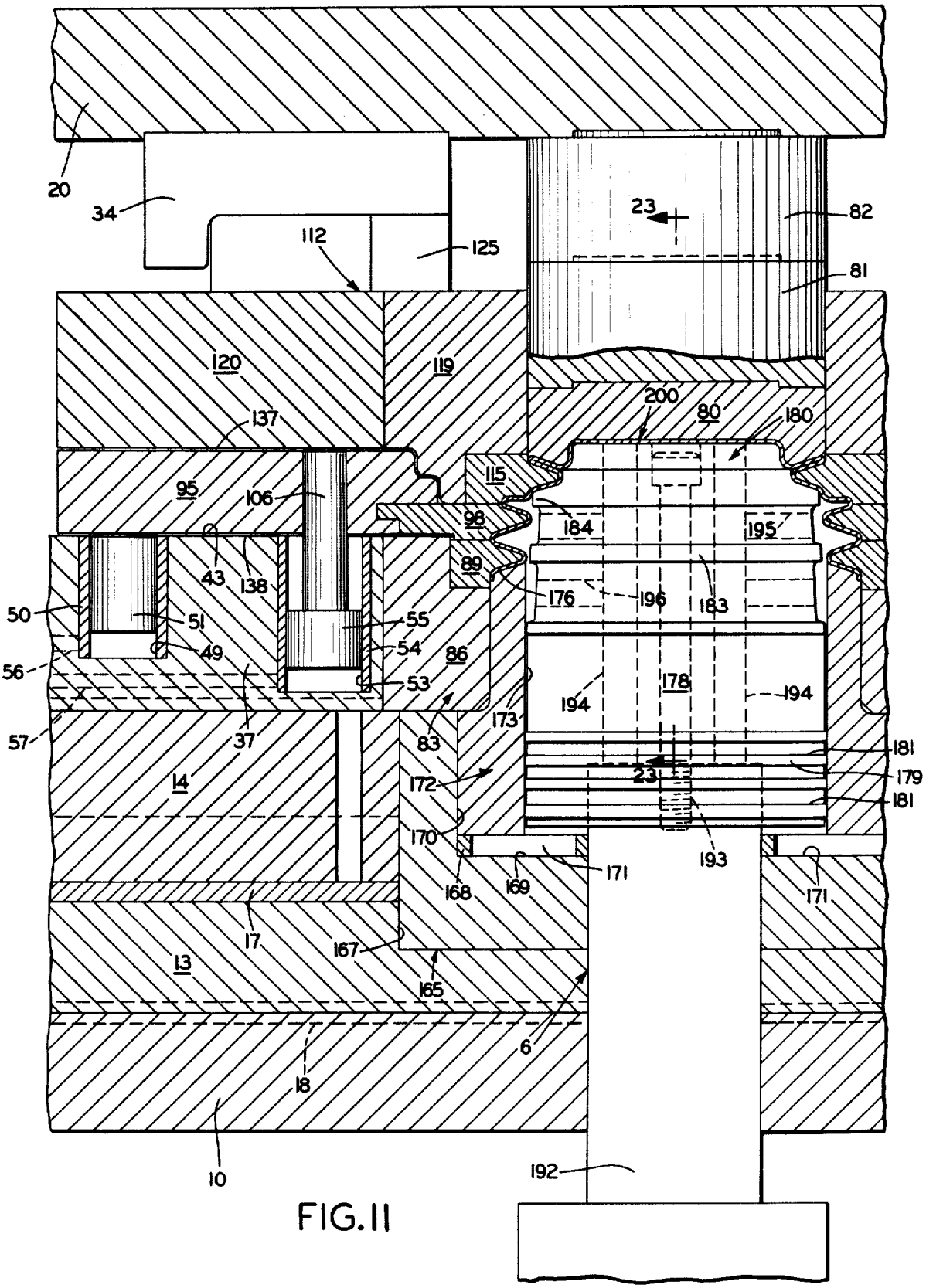
FIG. 11 is a section view similar to FIGS. 10 and 10A showing the position of the dies and associated components upon completion of the pulley forming procedure.
Figure 18:
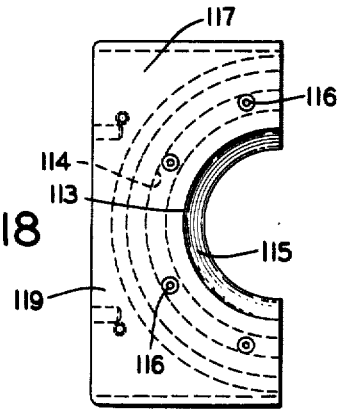
FIG. 18 is a top plan view of the top groove-forming die and holder therefor.
Figure 19:
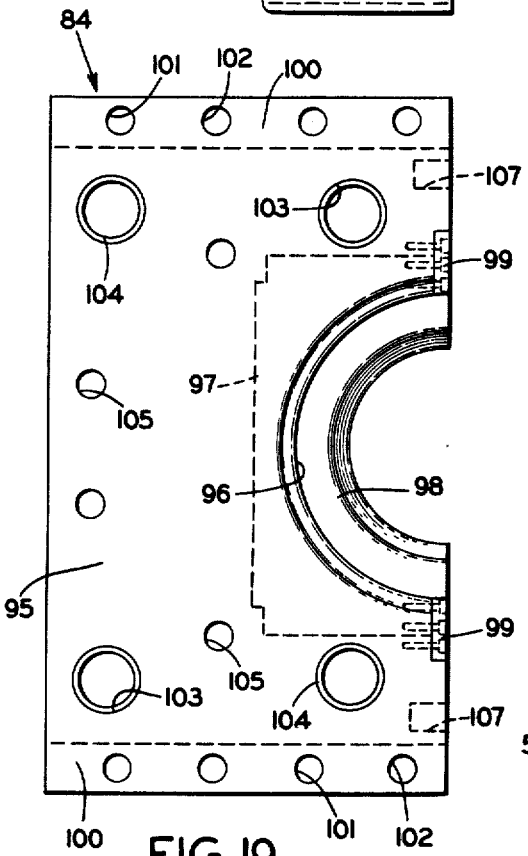
FIG. 19 is a top plan view of the middle groove-forming die and holder therefor.

A stepped configuration 128 is formed on the outer bottom portion of die holding block 119 (FIG. 10) for cooperatively engaging a similar stepped configuration formed on the top inner portion of intermediate die holder 95 when the dies are in a vertically closed position (FIGS. 10*a* and 11). A pair of alignment holes 129 (FIGS. 8, 9 and 21) are formed in the inner end faces of the lefthand slide block 120 for receiving alignment pins 130 which extend horizontally outwardly from the opposite end face of the right-hand slide block 120. A pair of longitudinally extending flanges 131 (FIGS. 21 and 23) are formed on slide block 120 and are provided with a plurality of spaced unthreaded holes 132.

In accordance with another feature of the invention, a plurality of bolts 133 and 134 (FIGS. 1 and 23) are mounted in an alternating arrangement along the sides of inner die subassembly 5. Bolts 133 extend downwardly through unthreaded holes 132 and 102 formed in flanges 131 and 100, respectively, and are threadably engaged in threaded holes 59 of flange 58. Adjusting nuts 135 are mounted on the threaded ends of bolts 133 and engage the underside surface of flange 100. Bolts 134 project upwardly through unthreaded holes 60 and threaded holes 101 of flanges 58 and 100, respectively, and abut against the underside surfaces of flanges 131 of slide block 120. Adjusting nuts 136 are mounted on the threaded ends of bolts 134 and engage the top surface of flanges 100. Bolts 133–134 and adjusting nuts 135–136 enable the amount of vertical spacing, indicated at 137 and 138, between top die holder 112 and intermediate die holder 95 and between die holder members 36 and intermediate die holder 95 to be regulated, ensuring complete contact and engagement between forming dies 89, 98 and 115 when upper ram plate 20 and top die 80 are in a vertically closed position (FIG. 11), as discussed in greater detail below.

Vertical Locking Subassembly 4

In accordance with another feature of the invention a vertical locking subassembly 4 is operatively engaged with each guide post 21 to lock top die 80 in a closed die position. Referring particularly to FIGS. 1, 2 and 12–17, a locking subassembly 4 is mounted on the top surface of plate 20 adjacent each guide post 21 for engagement therewith to mechanically lock top die 80 at the bottom of its vertical stroke. Each subassembly is similar; therefore, only one is described in detail.

Subassembly 4 includes upper and lower cam boxes 141 and 142, respectively, which are mounted on the top surface of plate 20 by four corner bolts 143 and a pair of guide pins 144. Each cam box 141 and 142 is formed with a vertically extending circular hole 145 through which guide post 21 extends for sliding vertical movement of ram plate 20 therealong. Cam boxes 141 and 142 also are formed with horizontally extending, generally semicylindrical-shaped recesses 146 and 147 which are in juxtaposition to each other forming a horizontally extending cylindrical opening 148. Recesses 146 and 147 communicate with vertical holes 145, as shown in FIGS. 14–17.

A cam shaft 150 is rotatably mounted in cam box opening 148 on a pair of spaced bushings 151. Shaft 150 is formed with a rectangular-shaped cutout 152 which is diametrically opposite an eccentric camming surface 153 which preferably is formed integrally with shaft 150. Shaft cutout 152 is located adjacent guide post 21 and enables shaft 150 to move freely past post 21 during vertical movement of ram plate 20 without contacting posts 21.

One end of a link 155 is fixed to an end of cam shaft 150 with the opposite end of link 155 being pivotally mounted by a pin 156 within the open end of a clevis 157. Clevis 157 is attached to the outer end of a piston rod 158 of a hydraulic cylinder 159. Cylinder 159 is pivotally mounted by a pin 160 on a mounting bracket 161 which is attached by bolts 162 to the top surface of ram plate 20.

The operation of locking subassembly 4 is shown primarily in FIGS. 12–17. During the hydraulic pulley forming operation, described in detail below, ram plate 20 will move from its raised position of FIG. 1, wherein cam shafts 150 are located generally adjacent to the tops of guide posts 21, to a lower position shown in FIGS. 12–13, wherein cam shafts 150 are horizontally aligned with post cutout portions 28. Upon ram plate 20 and hub forming die 80 reaching the bottom of their vertical stroke, cylinders 159 will move piston rods 158 outwardly pivoting link 155 from the unlocked position of FIG. 12 to the locked position of FIG. 13 which rotates cam shafts 150 in a counterclockwise direction. This counterclockwise rotation of shafts 150 rotate eccentric camming surfaces 153 into post cutouts 28 and into camming engagement with curved corners 32 of bearing plates 29 (FIGS. 16–17) to provide a wedging type of mechanical locking action between plate 20 and posts 21.

Interior Die Subassembly 6

Subassembly 6 is shown particularly in FIGS. 10, 11, 23 and 26. A stepped, annular-shaped backup plate 165 is mounted by bolts 166 in a circular-shaped recess 167 formed in fixed bottom slide 13. A flat disc-shaped die holder 168 is mounted on bottom surface 169 of a recess 170 which is formed in backup plate 165. A plurality of elongated, radially extending slots 171 are formed in die holder disc 168. A generally cylindrical-shaped sleeve 172 having a smooth cylindrical internal bore 173 is telescopically mounted within recess 170 of backup plate 165 and is supported on die holder 168. Sleeve 172 has a reduced diameter cylindrical-shaped upper portion which is clamped between the inner surfaces of bottom die holders 86 which form semicylindrical recesses 87 when die holding members 36 are in closed position. Sleeve 172 is secured in recess 170 by a plurality of circumferentially spaced bolts 177. Bottom dies 89 clamp an outwardly flared conical surface of a pulley cup blank 175 against a complementary-shaped angled sleeve surface 176 (FIG. 10) to mount blank 175 in position prior to the hydraulic bulge forming of a grooved pulley.

A draw stake, indicated generally at 180 (FIGS. 10, 11 and 23), is mounted for reciprocal vertical movement within sleeve bore 173 and together with sleeve surface 176 provides the internal die for forming the final pulley product in cooperation with inner die means 83, 84 and 85 and top die 80. Draw stake 180 has a generally stepped cylindrical configuration with a bottom cylindrical portion 178, generally complementary to sleeve bore 173. Bottom portion 178 is formed with a plurality of annular grooves 181 in which sealing O-rings 179 are mounted. A reduced diameter intermediate annular ring 183 is spaced above the cylindrical bottom portion 178 with a second annular ring 184 being located between intermediate ring 183 and a circular horizontal top surface 185 of draw stake 180. A first axially extending surface 186 communicates with top surface 185 and an outwardly downwardly extending conical surface 187 which teminates into upper annular ring 184. A reduced diameter first annular surface 188 separates upper ring 184 from lower ring 183, and a second reduced diameter annular surface 189 separates lower ring 183 from cylindrical bottom portion 180 (FIG. 10A). The functions of these various surfaces are described in detail below.

Draw stake 180 is attached to the upper portion of a hydraulic-actuated piston 192 by a pair of mounting bolts 193 (FIG. 10). A pair of axially extending fluid passages 194 (FIG. 11) is formed axially through the center of draw stake 180 and communicates individually with a pair of radially extending fluid paspassages 195 and 196. Draw stake 180 is shown in FIG. 11 rotated 90° from the position shown in FIG. 10 to better illustrate the configuration of stake 180.

Starting Blank and Final Pulley Product

Figure 5:
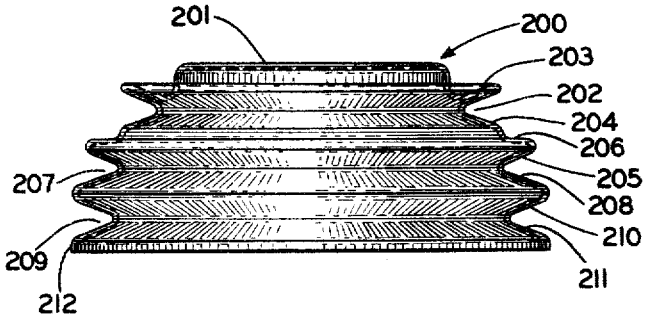
FIG. 5 is an elevational view of a V-grooved pulley product formed from the cup-shaped blank of FIG. 4 by the apparatus of FIGS. 1-3.

A formed pulley product of the type which is produced by apparatus 1 of the invention is indicated generally at 200, and is shown in FIG. 5. Pulley 200 is shown as a three-groove pulley in which the grooves are of different diameters. However, it is to be understood that pulleys formed by improved apparatus 1 may have a different number of grooves and groove configurations than that shown in FIG. 5, without departing from the concept of the invention. Pulley 200 is formed of sheet metal and is of the type primarily adapted for use in automotive application, although it may be used in other applications wherein a low-cost, balanced, uniform and efficient pulley construction is desired.

Pulley 200 includes a horizontal hub wall 201 separated from a first or inner groove 202 by a double thickness groove forming wall 203. A complementary angled conical wall 204 forms the other wall of groove 202 and is connected to an intermediate groove-forming wall 205 by a generally horizontally extending wall 206. An intermediate groove 207 is formed by wall 205 and a complementary-shaped conical wall 208. An outer groove 209 is formed by groove forming walls 210 and 211, with wall 211 terminating in an axially extending end flange 212.

Figure 4:
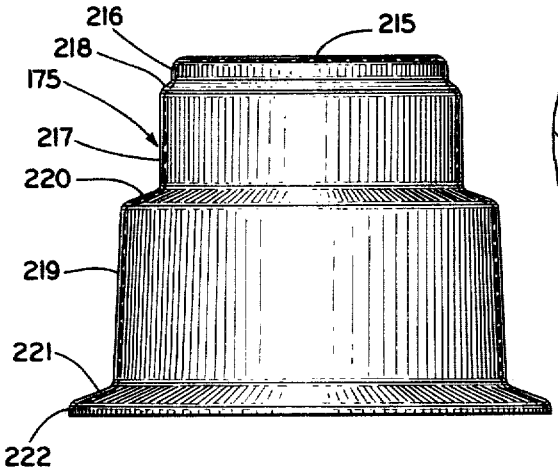
FIG. 4 is an elevational view of a sheet metal, cup-shaped starting blank for forming a pulley in the apparatus shown in FIGS. 1-3.
Figure 26:
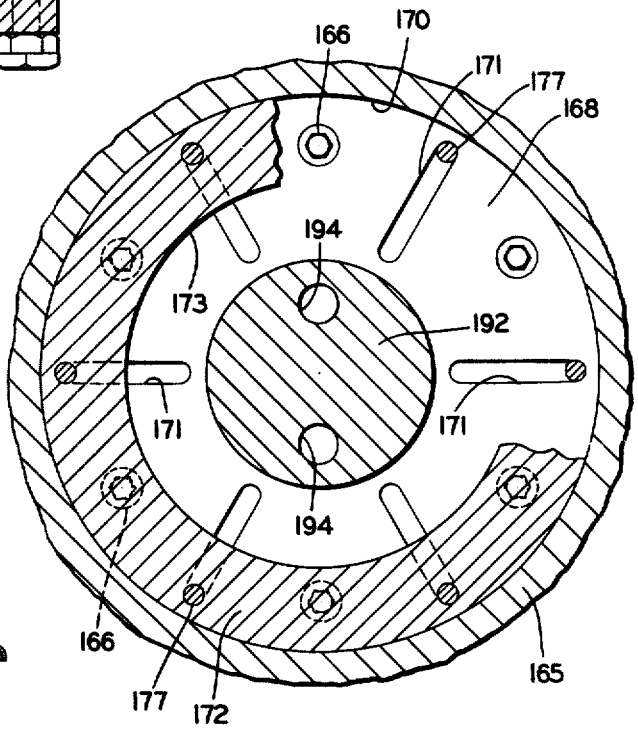
FIG. 26 is a fragmentary sectional view taken on line 26—26, FIG. 10.

Pulley 200 is formed from a cup-shaped blank 175, shown particularly in FIG. 4. Blank 175 includes a horizontal hub wall 215, which becomes hub wall 201 of pulley 200. A first axially extending wall 216 is connected to a larger second or intermediate axially extending wall 217 by a conical wall 218. A third or outer generally axially extending wall 219 is connected to intermediate axial wall 217 by a second conical wall 220. Axial wall 219 terminates in a third conical wall 221 which terminates in an axial flange 222 which form groove wall 211 and flange 212, respectively, of pulley product 200.

Hydraulic System

The hydraulic system for operating the various components of improved apparatus 1 is shown diagrammatically in the schematic illustration of FIG. 25. Only the main hydraulic components are shown in FIG. 25 and described below. A conventional electric motor 225 is utilized to drive two pumps 226 and 227. Pump 226 is a high-volume, low-pressure pump for rapid advancement and retraction of the various cylinders before and after pulley formation. Pump 227 supplies the pressure for a hydraulic intensifier, indicated generally at 230 and located within the dash lines.

Each pump preferably has solenoid-operated relief valves (not shown) associated therewith and is connected to an oil supply sump or reservoir 228. Pressure lines 231 and 232 connect pumps 226 and 227, respectively, to the various cylinders, described above and illustrated diagrammatically in FIG. 25, through a main header line or manifold 233. An accumulator 234 is connected to manifold 233 to assist in maintaining the correct fluid supply and pressure in the hydraulic system.

Ram plate 20 is reciprocated vertically by piston 7 of a hydraulic press with which apparatus 1 is intended to be used. Piston 7 is connected to manifold 233 by lines 235 and 236 through a pair of directional control valves 237 and 238. Cylinders 159 of vertical locking subassembly 4 are connected to manifold 233 by lines 239 and 240 through appropriate control valves 241.

Cylinders 11, which contain pistons 12 for reciprocally moving die-holding members 36, are connected to manifold 233 by lines 242 and 243. A check valve 244 is placed in each line 242 and a directional control valve 245 communicates with both lines 242 and 243. Pistons 55, which vertically move top die means 85, are connected to manifold 233 by pressure line 247. Pistons 51, which vertically move intermediate die means 84, are connected to manifold 233 by a pressure line 248. Appropriate directional control valves 249 and 250 are operatively connected with lines 247 and 248, respectively, for regulating and controlling the fluid flow and pressure supply to pistons 55 and 51.

Pistons 71, which control the vertical movement of tapered locking pins 72, are connected to manifold 233 by lines 252 and 253 with a control valve 254 being operatively engaged therewith. Piston 192 which imparts vertical movement to draw stake 180 is connected to manifold 233 by lines 256 and 257, again in cooperation with a control valve 258.

A motor 260 drives a pump 261 which supplies the hydraulic bulging fluid to the interior of a captured pulley blank 175 through a pressure line 262 which ultimately connects to vertical fluid passages 174 and horizontal fluid passages 195 and 196 which are formed in draw stake 180. Appropriate relief and check valves 263 and 264 communicate with line 262.

Hydraulic intensifier 230 is of a usual construction, having an injection cylinder 266 which communicates with a fluid fill and air drain junction block 267. Intensifier 230 is connected by line 268 with the hydraulic bulging feed line 262 for imparting a burst of high pressure to the trapped fluid within the partially formed pulley, as described below. A relief valve 269 is located between junction block 267 and fluid reservoir 228.

Various limit switches, additional valves and the like are provided and are interconnected to the components discussed above for controlling the hydraulic movement of the various pistons and are interconnected by suitable electrical circuits (not shown) including timer mechanisms to operate in a programmed, timed sequence of operation. Many of the hydraulic and electrical components and their relationships with respect to each other are similar to those shown in U.S. Pat. Nos. 3,837,200 and 3,935,627 and are incorporated by reference into this description.

Operation

The operation of improved apparatus 1 for forming pulley product 200 from starting blank 175 comprises a continuous single operational step. The pulley is formed by a continuous displacement of the metal of blank 175 into the desired shape by bulging, clamping and groove formation by continued mechanical displacement of the forming dies in a predetermined order and sequence and continuously coordinating and adjusting the volume of liquid within the blank and resulting pressure so as to control internally the shaping and displacement of the metal in the blank. This sequence then is followed preferably by the injection of a burst of extremely high energy to the confined liquid to final set the metal of the formed pulley eliminating "springback" of the metal after removal of the pulley from the forming dies.

As noted above, apparatus 1 is adapted to be mounted on a conventional press which is actuated to reciprocate vertically by hydraulic cylinder 7 or motors (not shown) in a usual manner for imparting vertical movement to top ram plate 20 while providing a rigid bottom support on which apparatus 1 is mounted. The hydraulic fluid, such as water or oil, or a combination thereof, which is supplied to the interior of blank 175, is regulated and controlled in both amount and pressure by a hydraulic system, such as described briefly above. Other control systems used for other types of hydraulic operations could be modified and used with improved apparatus 1 without affecting the concept of the invention and forms no particular part of the present invention.

At the start of a pulley forming operation, die holding members 36 are retracted by cylinders 11 to an open position, partially shown in FIG. 7, with top ram plate 20 and top die 80 being in their raised upper position. A blank 175 is placed manually on sleeve 172 with conical wall 221 of blank 175 being supported on sleeve surface 176. Die holding members 36 then are moved laterally inwardly by cylinders 11 to their closed position of FIGS. 1, 6 and 10 with bottom forming die 89 clamping blank wall 221 tightly against sleeve surface 176 (FIG. 10). Top die means 85 and intermediate die means 84 have been moved previously to their raised position by pistons 55 and 51, respectively.

In accordance with one of the features of the invention, upon the closing of holding members 36, shelves 61 and 62 move from their separated open position of FIG. 9 to the overlapped, closed position of FIG. 8. Hydraulic pistons 71 are actuated, forcing tapered ends 72 vertically upwardly through aligned tapered holes 65 and 66 to wedgingly lock die holding members 36 and die means 83, 84 and 85 in a horizontal closed position. Alignment pins 68 project into alignment holes 67 of the left-hand end shelves 61 to ensure proper alignment of the various components when the shelves are moved from their open position of FIG. 9 to the closed position of FIG. 8. If desired, the pressure exerted by hydraulic cylinders 11 on members 36 may be relaxed or reduced after engagement of tapered ends 72 with shelves 65–66 since they are not required to maintain members 36 in closed position due to the positive mechanical locking in the horizontal direction provided by tapered ends 72.

Generally simultaneously with the inward movement of die holding members 36, top ram plate 20 and top die 80 are moved downwardly toward the position shown in FIG. 10, whereupon top die 80 engages hub wall 215 of blank 175. Draw stake 180 also is moved vertically upwardly by piston 192 to the position of FIG. 10 with conical surface 187 of draw stake 180 clamping intermediate conical surface 220 of blank 175 against a bottom surface of top die 115.

Hydraulic fluid then is supplied to the interior of captured blank 175 through vertical fluid passages 194 and into the void spaces between blank hub 215 and top surface 185 of draw stake 180. Fluid also may be injected into the annular spaces between portions of the blank side wall and draw stake annular surfaces, such as 188, partially bulging the blank side walls outwardly toward the forming dies, as shown in FIG. 10A. In accordance with one of the features of the invention, the particular sequence of forming pulley grooves 207 and 209 may be regulated by the independent vertical movement of top and intermediate die means 85 and 84 by hydraulic pistons 55 and 51. Continued downward movement of top ram plate 20 and die 80 in coordination with the hydraulic fluid supplied to the interior of trapped blank 175 through passages 194, 195 and 196, bulges and forms the metal into the pulley configuration shown in FIG. 11. Again, the details and sequence of the particular hydraulic bulging operation described briefly above are similar to that described in greater detail in U.S. Pat. Nos. 3,837,200 and 3,935,627.

Upon die 80 and ram plate 20 reaching the bottom of their vertical stroke (as shown in FIG. 11), cylinders 159 are actuated which pivots links 155 and rotates cams 150 to wedgingly engage camming surfaces 153 with curved corners 32 of bearing plates 29 to positively mechanically lock the dies in vertically closed position. When in the vertically closed position of FIG. 11, groove-forming dies 89,98 and 115 are clamped solidly together by the locking pressure of subassembly 4, preventing metal from flowing between the abutting surfaces and creating die marks, as in prior hydraulic bulging apparatus.

After the dies are in this vertically closed and locked position, a burst of high energy is applied to the captured fluid within blank 175, preferably by a hydraulic intensifier 230. This pressure is sufficient to exceed the elastic limit of the blank metal and completely forces the metal into and throughout the groove-forming dies to final form the pulley product 200. Upon retraction of the closed dies, pulley 200 will maintain its final formed shape and will not spring back, which would occur if the elastic limit of the metal had not been exceeded. If desired, a pressure less than that of the elastic limit of the metal can be applied to the trapped fluid during the final forming stage. If this reduced pressure is used, the dies are designed whereby the amount of springback which will occur is compensated for by increasing the volume within the forming dies so that when the pulley is removed from the dies it will spring back and assume the desired final shape. The amount of springback which will occur can be calculated and compensated for in the dies.

In addition to the independent movement and sequence of operation of top and intermediate die means 85 and 84, adjustment bolts 133 and 134 insure full and complete abutting engagement between the groove-forming dies, as shown in FIG. 11, preventing the movement of any metal therebetween by regulating vertical spacings 137 and 138 between the die holders.

Improved apparatus 1 provides a construction in which the groove-forming dies consist of half die segments which are clamped together by positive mechanical clamping and locking means in both the horizontal and vertical directions so that no metal can be forced between the junction areas of the dies during the high-pressure bulging operation leaving die marks, as in prior apparatus. The improved apparatus also enables a variety of groove-forming sequences to be achieved by changing the sequence of vertical movement between the top, bottom and intermediate groove-forming dies by their associated pistons.

Accordingly, the improved hydraulic pulley forming apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved hydraulic pulley forming apparatus is constructed and used, and characteristics of the construction, and the advantageous, new and useful results obtained; the new and useful structures, devices, elements, arrangements, parts, and combinations, are set forth in the appended claims.

We claim:

1. Apparatus for hydraulically forming a grooved pulley from a cup-shaped sheet metal blank having a bottom hub wall and a side wall, said apparatus including:

(a) base means;

(b) a pair of die holding members mounted on the base means for reciprocal movement toward and away from each other on said base means;

(c) internal die means adapted to support a sheet metal blank between the die holding members;

(d) groove-forming die means mounted on each of the die holding members for capturing a blank supported by the internal die means and for forming at least a single groove in the side wall of the blank;

(e) pin means operatively engageable with the die holding members for clamping the die holding members and groove-forming die means in a closed position in the horizontal direction;

(f) a plurality of post means mounted on the base means and extending vertically upwardly therefrom;

(g) means for supplying fluid to the interior of a captured blank when the die holding members and die means are in closed position;

(h) ram means mounted on the post means for reciprocal vertical axial movement therealong;

(i) hub wall engaging die means mounted on the ram means and engageable with the bottom hub wall of a blank for axially compressing a captured blank in cooperation with hydraulic bulging of the side wall outwardly toward the groove-forming die means when the ram means moves downwardly toward a die vertical closed position;

(j) locking means operatively engageable with the post means and ram means for locking the hub wall engaging die means in a vertically closed die position when the ram means is at the end of its axial compression stroke; and (k) means for increasing the pressure of the hydraulic fluid trapped in the compressed blank to final form the pulley groove.

2. The apparatus defined in claim 1 in which each of the die holding members is formed with a pair of diametrically spaced, horizontally extending shelves; in which an opening is formed in each of the shelves; in which adjacent shelves of the opposite die holding members lie in vertical overlapping relationship with respect to each other when the groove-forming die means and die holding members are in closed position, with the adjacent shelf openings being in vertical alignment; in which the pin means is a pair of vertically reciprocally movable pins having tapered ends; and in which the tapered pin ends extend through the aligned shelf openings to wedgingly clamp the die means and holding members in closed position in the horizontal direction.

3. The apparatus defined in claim 1 in which the ram means includes a horizontal plate having top and bottom surfaces; in which the hub-engaging die means is mounted on the bottom surface of the ram plate; and in which the locking means is mounted on the top surface of the ram plate and includes a plurality of piston-actuated links and associated camming surfaces operatively engageable with the post means.

4. The apparatus defined in claim 3 in which the locking means includes a plurality of cam boxes, each being associated with a respective post; in which a shaft is rotatably mounted in each of the cam boxes by the links, with the camming surfaces being formed on the shafts; and in which a plurality of pistons are mounted on the top surface of the ram plate adjacent the cam boxes and operatively rotate the cam shafts to control the locking and unlocking of the hub wall engaging die means with respect to the inner groove-forming dies.

5. The apparatus defined in claim 1 in which the groove-forming die means includes bottom, intermediate and top die means, each of said die means having a die holder and a die mounted on said holder; in which the bottom die means is mounted in a fixed position on the die holding member with respect to both the horizontal and vertical direction; and in which the intermediate and top die means are movably mounted on the die holding members for movement in the vertical direction only with respect to said die holding members.

6. The apparatus defined in claim 5 in which a plurality of hydraulically actuated piston means are operatively selectively engaged with the intermediate and top die means for controlling the vertical movement of said intermediate and top die means with respect to the die holding members.

7. The apparatus defined in claim 6 in which a plurality of vertically extending piston bores are formed in the die holding members with pistons slidably mounted in said bores; in which hydraulic fluid supply passages are formed in the die holding members and communicate with the piston bores; and in which certain of the pistons are operatively engageable with the intermediate die means and other of the pistons extend through openings formed in the intermediate die means and operatively engage the top die means for vertically moving said intermediate and top die means.

8. The apparatus defined in claim 5 in which a plurality of guide pins are mounted on each of the die holding members and project vertically upwardly therefrom; in which a plurality of vertically aligned openings are formed in the intermediate and top die holders; and in which the guide pins extend through said die holder openings for vertically slidably mounting said intermediate and top die means on the die holding members.

9. The apparatus defined in claim 5 in which the dies each have a semicircular configuration whereby said dies form a closed circular configuration when the die means are in a horizontally closed position.

10. The apparatus defined in claim 5 in which a plurality of vertically extending bolt means are operatively engaged with the die holders for the groove-forming die means and provide stops for adjusting the vertical spacing between said die holders when the groove-forming die means are in a vertically closed position.

11. The apparatus defined in claim 10 in which flanges are formed on the die holders and are located on laterally opposite sides of said die holders; in which a plurality of holes are formed in the die holder flanges; and in which the stop bolt means extend through the flange holes for adjusting said die holders vertically with respect to each other.

12. The apparatus defined in claim 1 in which each of the die holding members has a generally L-shaped vertical cross-sectional configuration with a vertical end portion and a horizontal base portion; and in which a cutout is provided in the horizontal base portion and forms a pair of laterally spaced end shelves; in which a tapered opening is formed in each of the end shelves; in which the adjacent shelves of the die holding members lie in vertical overlapping relationship with respect to each other when said members are in closed position with the shelf openings being vertically aligned; and in which the pin means have tapered ends which project into the vertical aligned shelf openings to clamp said die holding members in a horizontally closed position.

13. The apparatus defined in claim 12 in which horizontally extending alignment pins and complementary alignment holes are provided on forward edges of the end shelves of the horizontal base portion of the die holding members for aligning the pair of die holding members when moving toward a horizontally closed position.

14. The apparatus defined in claim 1 in which the interior die means includes an annular sleeve and a draw stake vertically reciprocally mounted in said sleeve; in which means is provided for moving the draw stake axially relative to the hub of a blank to vary the effective volume within said blank; and in which a plurality of annular ring means are formed on the draw stake for cooperation with the groove-forming die means in hydraulically forming a plurality of pulley grooves.

15. The apparatus defined in claim 1 in which the bulging fluid is a liquid.

16. The apparatus defined in claim 1 in which the means for increasing the pressure of the hydraulic fluid to final form the pulley groove is a momentary burst of high energy applied to the trapped fluid, said energy being of a sufficient magnitude to set the metal of the blank by exceeding the elastic limit of the metal to eliminate springback after the pulley is removed from the die means.

17. The apparatus defined in claim 16 in which the hydraulic fluid is a liquid; and in which the means for applying a momentary burst of high energy to the trapped liquid is a liquid intensifier.

* * * * *